US007854037B2

(12) United States Patent
Lu

(10) Patent No.: US 7,854,037 B2
(45) Date of Patent: Dec. 21, 2010

(54) PAINT PAD WITH ADJUSTABLE HANDLE

(76) Inventor: Jianxin Lu, No. 3 Xinheng 7th Road, Cicheng Industrial Zhone, Ningbo, Zhejiang Province (CN)

( * ) Notice: Subject to any disclaimer, the term of this patent is extended or adjusted under 35 U.S.C. 154(b) by 1221 days.

(21) Appl. No.: 11/423,207

(22) Filed: Jun. 9, 2006

(65) Prior Publication Data

US 2007/0226935 A1 Oct. 4, 2007

(30) Foreign Application Priority Data

Apr. 4, 2006 (CN) ..... 2006 2 0102340 U

(51) Int. Cl.
*A47K 7/02* (2006.01)

(52) U.S. Cl. ..... 15/210.1; 15/208; 15/209.1

(58) Field of Classification Search ..... 15/208, 15/209.1, 210.1
See application file for complete search history.

(56) References Cited

U.S. PATENT DOCUMENTS

| | | | | |
|---|---|---|---|---|
| 4,219,899 | A * | 9/1980 | Zurawin et al. | 15/144.2 |
| 4,819,294 | A * | 4/1989 | Calvert | 15/209.1 |
| D482,202 | S * | 11/2003 | Newman et al. | D4/121 |
| 2006/0191088 | A1 * | 8/2006 | Goulet et al. | 15/144.1 |

* cited by examiner

*Primary Examiner*—Joseph J Hail, III
*Assistant Examiner*—Shantese McDonald
(74) *Attorney, Agent, or Firm*—Global IP Services; Tianhua Gu

(57) ABSTRACT

A paint pad with adjustable handle belong to painting tool field, includes a handle; a pad unite that includes a pad support body and a pad holder plate, the pad holder plate is connected to the bottom of the pad support body; wherein the pad support body has a handle groove on the top; a orientation part is under the groove, its up surface has a plurality of orientation teeth; the handle with plurality of adjusting teeth at the end of handle is located in the groove; a knob on the top of the pad support body can adjust the relationship between the orientation teeth and adjusting teeth. The conventional paint pad is fallible and instable for keeping stable angle between the handle and pad unite, it influences the painting route and uniformity, and reduces painting quality. The paint pad of the present invention allows the handle to have up & down vertically pivotal movement but not left & right swing; though the knob to adjust the engaging force between teeth, therefore, keep the right needed angle for stable operation. The new paint pad possesses advantages of easy in changing working situation, comfortable holding, big amount of absorbing paint, speedy painting, high quality in painting of corner wall areas and area with different colors and exchangeable of paint pad.

10 Claims, 3 Drawing Sheets

PAINT PAD WITH ADJUSTABLE HANDLE

CROSS REFERENCE TO THE RELATED PATENT APPLICATION

This patent application claims the priority benefit of the Chinese patent application No. 200620102340 filed on Apr. 4, 2006.

FIELD OF THE INVENTION

This invention relates to an innovative technology for the flat painting tool, especially a paint pad with adjustable handle.

BACKGROUND OF THE INVENTION

As a convenient and practical painting tool, flat painting brush and painting pad still occupy irreplaceable status and role when people paint the wall or other surfaces. Currently, the joint methods for the pad unite and pad handle can be traditional fixation or universal coupling connection. In the traditional one, the pad unite is fixed with its handle. The fixed but not flexible connection brings lot of inconveniencies. When the painting pad is used in painting wall corners or adjacent areas with different colors, operator need to change the angle between the handle and pad, but the traditional pant pad can not meet the requirements, thereby to influence the processing schedule and painting quality. Another kind of painting pad has universal coupling connection; the pad body or its handle is moveable around its mounting axis across a wide range of angles. Operator can use this kind of paint pad to overcome difficulties of operation, and increase painting quality since the universal coupling connection allows the paint pad to adjust its angle relating to the wall or other plate freely. However, this kind of paint pad has its flaws, the operator can not orientate the handle or pad, it is easy to slid and hard to control the operating angle, the painting quality is affected. Therefore, a new product is appeared in the market, which possesses both characteristics of the traditional and universal coupling paint pads. The new product has a circle ring between the handle and pad, and through the clamp force of a gasket controlled by the circle ring to force the paint pad to be fixed in a preset position within the range of left and right swing. Since the ring and its gasket control the clamp force between the pad and handle, it is quite common that the handle loses its clamp force when the ring or gasket wears out or be touched by out force. Therefore, this kind of paint pad is s till fallible and instable, which can influence the painting route and uniformity, and reduce painting quality.

SUMMARY OF THE INVENTION

The purpose of this invention is to solve and conquer all the flaws of the current flat painting tools, and provide a kind of new paint pad with adjustable handle, which can adjust the angle between the pad and handle, can swing handle up and down relating to the pad, but limit the swing left and right. The invention is realized by the following technical schemes:

A paint pad with adjustable handle comprises a handle; a pad unite that includes a pad support body and a pad holder plate; the pad holder plate is connected to the bottom of the pad support body; wherein the pad support body has a handle groove on the top; a orientation part is under the groove, its up surface has a plurality of orientation teeth; the handle with plurality of adjusting teeth at the end of handle is located in the groove; a knob on the top of the pad support body can adjust the relationship between the orientation teeth and adjusting teeth. The orientation part can be designed as an individual part, or as one part of the pad support body located on the bottom of the handle groove; the handle connects with the pad support body by an axle to make it easy operation by operators, the new tool meets different operating position and angle requirements. There is a handle groove on the top of the pad support body, the connecting end of the handle embeds into the handle groove to limit its left & right swing but allow its up & down vertical pivotal movement during operation. In addition, this structure is possible to fix the handle in a position when operator sponges paint, so that it will be easy for operator to erase superabundance, to avoid dripping everywhere. If operator needs handle to have a fixed position angle relating to the pad support body during painting, he can tighten it by turning the knob to engage the orientation teeth onto the adjusting teeth tightly, this movement generates enough engaging force to guarantee stable angle between the pad support body and the handle during operation. If the operator needs the handle having a pivotal movement freely, he can just unscrew the knob to free the orientation teeth with the adjusting teeth.

To perfect and supplement the above scheme, this invention can adopt the specific measures below:

There is a connecting channel at the front end of the handle groove; a screw hole is located at the front end of the orientation part; the knob is located between the connecting slot and screw hole; the knob has a stopping shoulder between the knob head and screw thread; the section between the stopping shoulder and the knob head is inserted moveably into the connecting groove, and the screw thread is screw connected with the orientation part. The purpose of the stopping shoulder is to keep the knob attaching with the pad support body when knob is unscrewed. When the knob is tightened, the orientation part is distorted, for example, the front of the orientation part is raised, make the orientation teeth to engage with the adjusting teeth tightly; this movement can keep the stable angle between the pad support body and panting surface, therefore, to make convenience to the operator to operate, and control the painting quality. When free the knob, the orientation part return back to normal shape, its front end descends for example, which would free the engage between the orientation teeth and adjusting teeth, and the handle can have pivotal movement freely again. During operation, the operator can first adjust the angle between the handle and the pad support body according to the requirement, thereafter, tighten the knob to fix it; or the operator can release the knob to readjust the angle; or just let the pad support body move pivotally freely. When the angle between handle and the pad support body is 0°, the end part of the handle just fits in the groove; when the angle between handle and the pad support body is 90°, the knob stops the handle further movement to avoid excess swing and destroying of the pad support body.

The pad support body has guide rollers at its front end. Setting the guide rollers can achieve neat borderline painting since the roller can follow the wall or the sidelines of an object's surface or be assisted by other tools, like guiding ruler. The guide rollers especially suit for painting the corners, the joint area of different colors, it is really easy to operate, and produce high quality.

The pad support body has cavity at its front top. Two roller shafts stand vertically related to pad holder plate inside the cavity, guider rollers sleeve on the roller shafts moveably. The cavity can prevent paint or other paste to jam the roller shafts and guide rollers, guarantees all parts to work properly.

The pad holder plate has flanges, which are located on the opposite sides of the pad holder plate and connected to the corresponding side edges of the pad support body. This structure facilitates the operation and decrease the painting cost significantly since it makes possible to change only pad holder plate not the whole pad unit when the operator use different paint (different color for example) or pad holder plate is destroyed.

The flanges of pad holder plate and the edge of pad support body both have lock grooves which have a same shape and overlap when assembly. A flange lock with an outward-hem is inserted into the lock grooves and its outward-hem joins the corresponding side of the pad support body, lets the pad holder plate immobile, and prevents it to slip away from the pad support body. When the plate needs change, just release the flange lock and draw out the plate.

A paint pad is attached under the pad holder plate, and nylon hairs are planted the outside of the paint pad, or sponge with nylon hair adhered on the outside of the paint pad. This kind of paint pad using nylon hair as working surface, can absorb paint a lot, and can paint a large area of wall and other surface continuingly, the working efficiency is increased. The cross section of the paint pad can be rectangular, trapezium, parallelogrammic.

The connecting end of the handle is a cylindrical shape, the bottoms of the cylinder touch with the groove side surfaces, a transverse axis is located the center of the cylinder; the inboard sides of groove have a couple of opposite slots, the transverse axis sets in the slots. It is very easy to set the transverse axis into the opposite slots, and this can limit the handle to swing left & right during operation, be easy for operator to control painting direction and improve quality. Also, the reason for the cylindrical shape of the connecting end of the handle is easy for the handle to swing within 0°-90° pivotal movement in the handle groove.

The orientation part has an open slot in its rear end, the orientation teeth are located between the screw hole and the open slot; two open blind slots having down direction are located on both sides of the open slop to connect with the stationary protrude on both side of rear section of the handle groove. When the knob is tightened, front end of the orientation part is raised because the screw hole is connected with knob, the blind slots cooperate with the stationary protrudes to force the orientation part to distort a little, and the orientation teeth to engage with adjust teeth tightly too. This movement locks a stable angle between the pad support body and the handle to prevent slip even the operator uses very sticky liquid.

The handle wraps with soft material to increase comfortable holding for long periods, and a screw bore in its end can be inserted a long staff to increase painting area.

This invention can allow the handle to have up & down vertically pivotal movement but not left & right swing relating to the pad support body and the painting surface. When the knob is tightened, the orientation teeth engage to the adjusting teeth, and this movement generates enough engaging force to guarantee stable angle between the pad support body and the handle during operation. When the knob is loosed, the orientation teeth and adjusting teeth are apart, thus the handle can move up & down freely, this makes operator easy to handle and operate, help to increase painting quality; also this design makes the pad holder plate easy exchangeable, and the pad can absorb more paint, it is quite usable when operator paints the corner or the adjacent areas with different colors, and reduce the cost significantly.

DETAILED DESCRIPTION OF THE DRAWINGS

1: handle, 1-1: screw bore, 2: adjusting teeth, 2-1: transverse axis, 3: pad support body, 3-1: opposite slot, 3-2: stationary protrude, 3-3: roller shaft, 4: handle groove, 4-1: connecting channel, 5: knob, 5-1: stopping shoulder, 5-2: knob head, 5-3: screw thread, 6: orientation part, 6-1: screw hole, 6-2: blind slot, 6-3: open slot, 6-4: orientation teeth, 7: guide roller, 8: lock groove, 9: flange lock, 10: paint pad, 11: pad holder plate, 12: flange, 13: lock groove

DETAIL DESCRIPTION OF THE INVENTION

Although the following detailed description contains many specifics for the purposed of illustration, any one of ordinary skill in the art will appreciate that many variations and alterations to the following details are within the scope of the invention. Accordingly, the following preferred embodiment of the invention is set forth without any loss of generality to, and without imposing limitations upon, the claimed invention.

Figure 1:
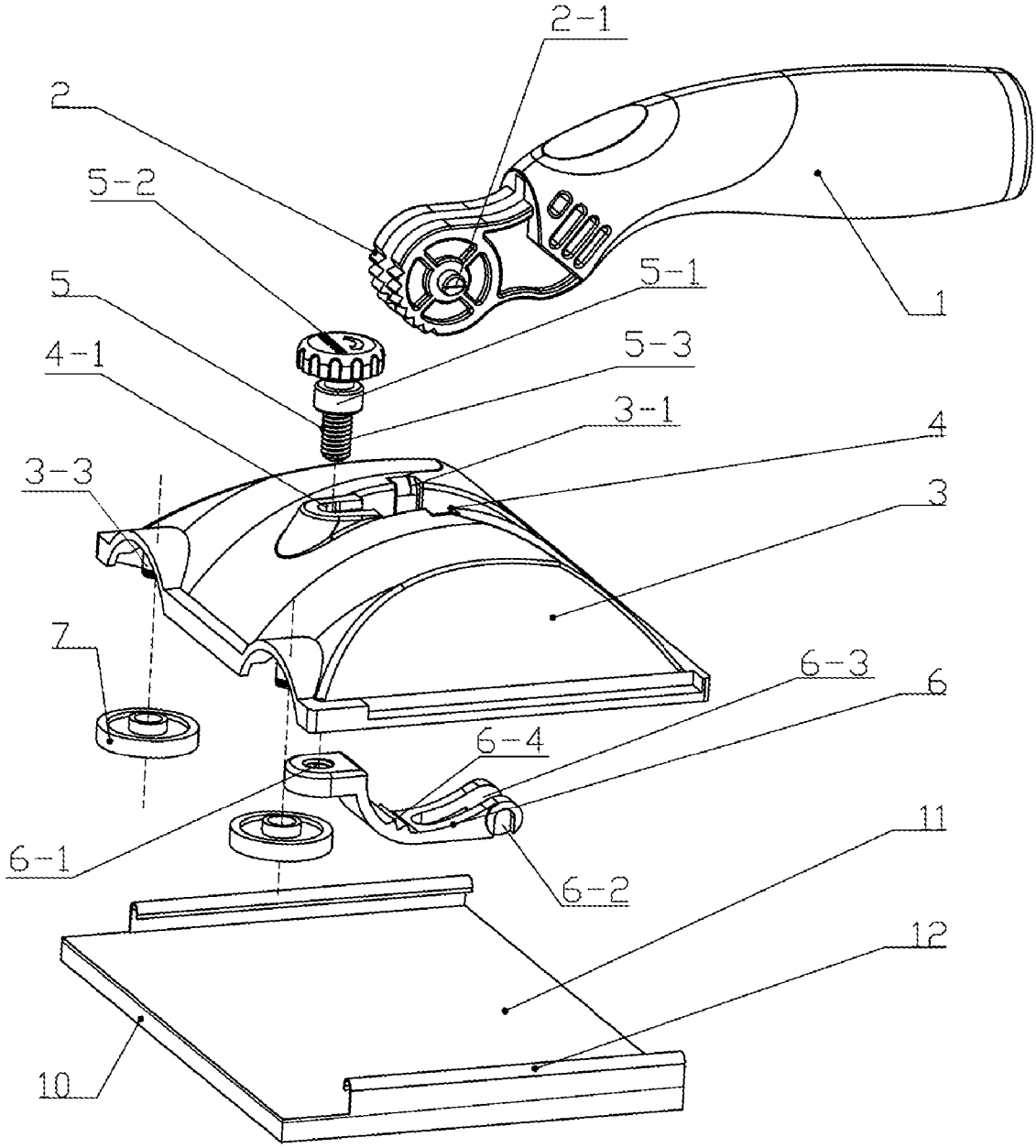
FIG. 1 is an exploded perspective view of the paint pad with adjustable handle in accordance with the present invention.
Figure 2:
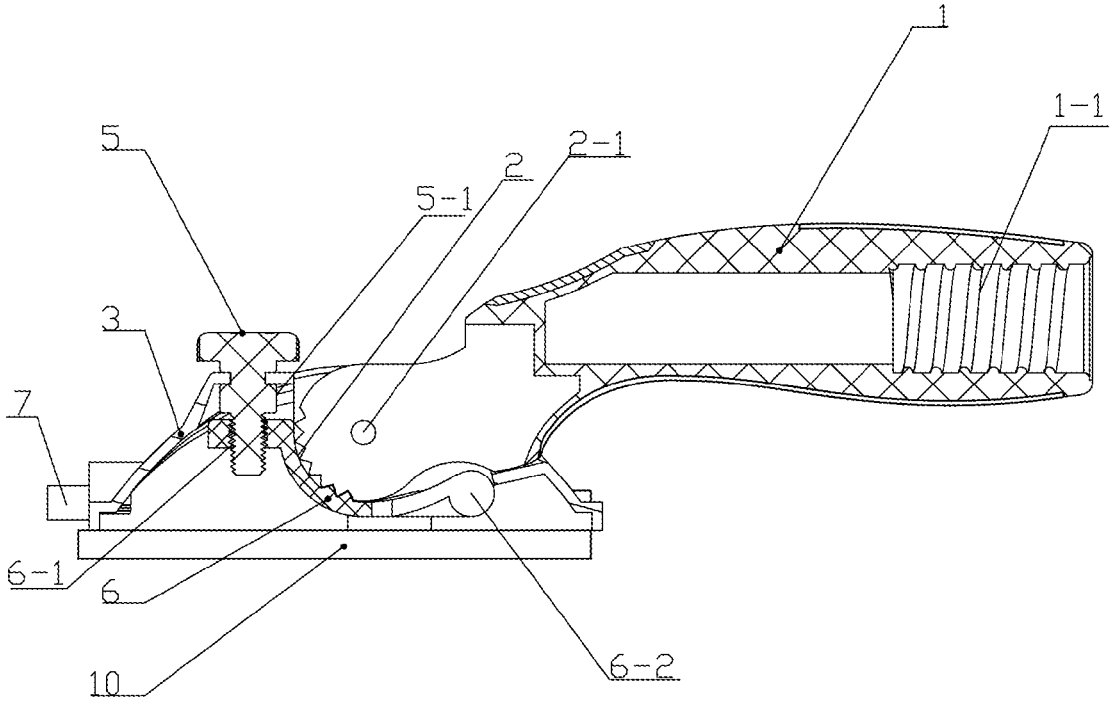
FIG. 2 is a cross section view of the paint pad with adjustable handle in accordance with the present invention.

FIGS. 1 and 2 show the first embodiment of the present invention.

As FIGS. 1 and 2 show, a paint Pad with Adjustable Handle has a handle 1 and a paint pad unite, which includes a pad support body 3, and pad holder plate 11. The Handle 1 is connected with the top of the pad support body 3 by axis 2-1, the end of handle near the axis is a the cylinder shape that is perpendicular to the direction of handle, quarter of the cylinder has plurality of adjusting teeth 2, a transverse axis 2-1 at the center of the cylinder; the handle 1 wraps with soft material, and a screw bore 1-1 is in its end, the handle 1 can have different length, also can attach a long staff into the screw bore 1-1 to increase painting area. There is a handle groove 4 which has the direction same as handle 1 on the top of the pad support body 3; a connecting channel 4-1 which is in front of the handle groove 4 is on the top of the pad support body 3 too; the connecting channel 4-1 is through with the handle groove 4; the inboard sides of the handle groove 4 have opposite slots 3-1, the transverse axis 2-1 sets in the opposite slots 3-1; the bottoms of cylinder just fits the width of the handle groove. The pad support body 3 has a cavity at top front; two roller shafts 3-3 stand vertically relating to the pad holder plate 11 inside the cavities; guider rollers 7 sleeve on the roller shaft 3-3. The orientation part 6 is inside the handle groove 4; a screw hole 6-1 is in front of the orientation part 6, a open slot 6-3 is in the rear end, two orientation teeth 6-4 are sat between the screw hole 6-1 and the open slot 6-3; two blind slots 6-2 are located in both side of the open slop 6-3 to connect with the stationary protrusion 3-2 which protrude on each side of the handle groove 4. The Knob 5 includes knob head 5-2 and screw thread 5-3, and stopping shoulder 5-1 between them. The connecting channel 4-1 inserts into the space between the knob head 5-2 and the stopping shoulder 5-1 moveably. When assembly, the knob 5 is slid into the connecting channel 4-1 through the handle groove 4, and turned into the screw hole 6-1 with its screw thread 5-3. When the knob is tightened with clockwise rotation, front end of the orientation part 6 is raised because its screw hole 6-1 connected with the screw thread 5-3; therefore, the stationary protrusion 3-2 in the blind slot 6-2 sleeves is pressed by the blind slot. This action lets the orientation part 6 to be distorted a little, and forces the orientation part 6 to pivot upon stationary shaft 3-2 to engage the orientation teeth 6-4 with the adjusting teeth 2 in the top of the handle tightly. This movement locks a stable angle between the pad support body 3 and handle 1. When knob is loosed with counter clockwise rotation, the handle 1 can swing within 0°-90° pivotal movement relating to the pad support body 3. Also, because the stopping shoulder 5-1 located inside the connecting channel 4-1, this prevents knob 5 falling off from the pad support body 3. The pad holder plate 11 is made of soft materials, and located under pad support body 3; the width of the pad holder plate 11 is the same as the width of bottom of the pad support body; a set of flanges 12 attach each side of the pad holder plate 11, the flanges 12 can connect the pad holder plate 11 with the corresponding sides of the pad support body 3. There is a paint pad 10 under the pad holder plate 11; nylon hairs are planted on the outside of the pad 10, or a sponge with nylon hair on the outside is adhered on the pad 10; the cross section of paint pad can be rectangular, trapezium, parallelogrammic.

Figure 3:
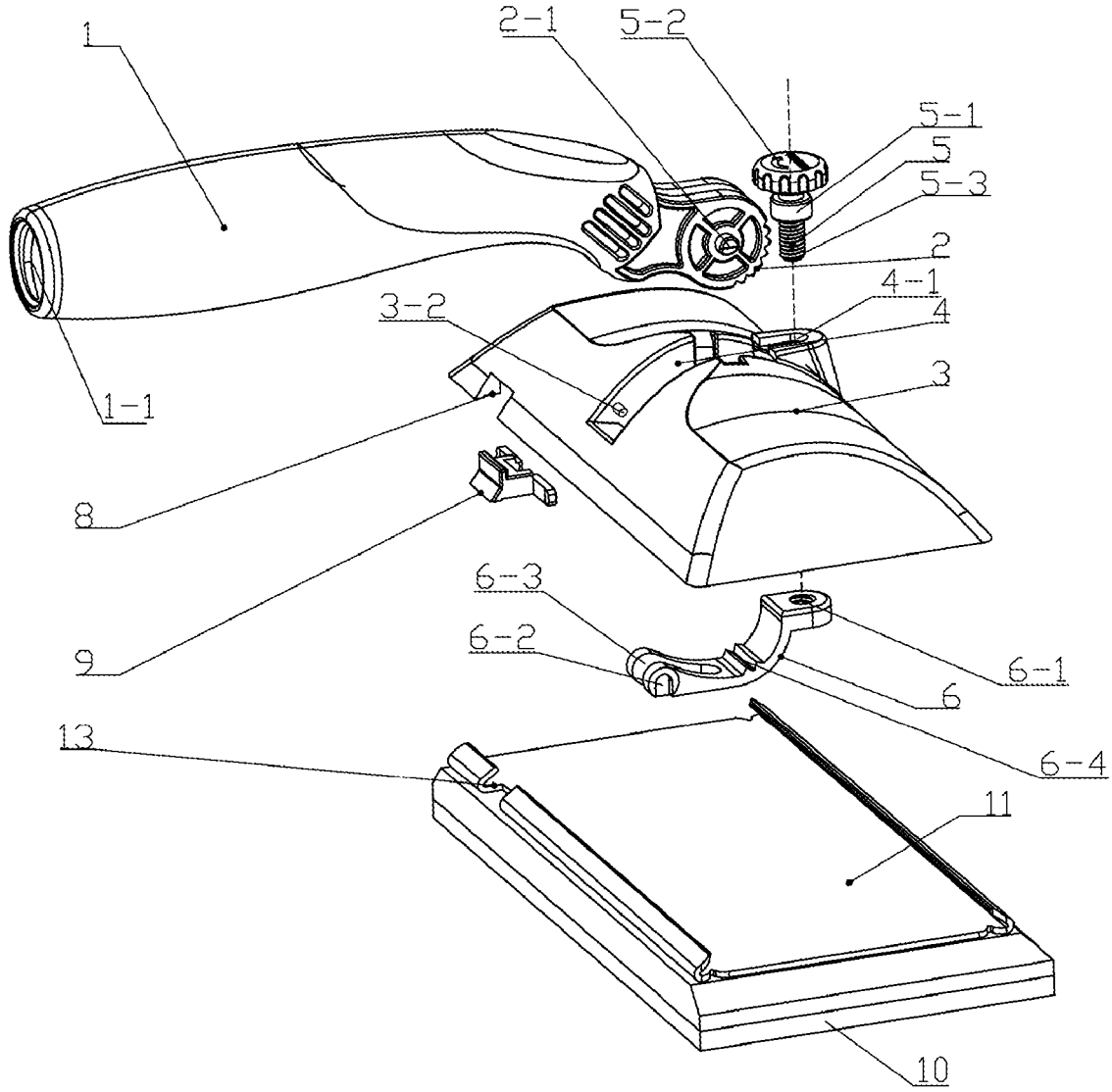
FIG. 3 is an exploded perspective view of a preferable embodiment in accordance with the present invention.

The FIG. 3 shows another embodiment of the present invention. Its components and assembly process are almost the same as the first embodiment described above. The only difference is that the flanges 12 are attached to the front and rear side of the pad holder plate 11, the flanges 12 connect the corresponding sides of the pad support body 3. The flange 12 and pad support body both have lock grooves 8 and 13, which are of same shape and overlapped when assembly. A flange lock 9 is inserted into the lock groove 8 and 13 to connect the pad support body 3 and pad holder plate 11 together firmly. This mounting method is suitable for large dimension pad holder plate, and easy for pad holder plate 11 to be attached to pad support body 3 firmly.

During operation, the operator can soak the paint pad 10 which is attached under the pad support body 3 in paint pot, and let the pad saturates with paint, erase superabundance, tighten knob 5 to prevent dripping everywhere, lift the handle 1 to paint the wall or other surfaces. If operator uses guide roller 7 to lean against wall, he can paints a nice and straight line. Especially, operator paints different colors on adjacent areas, he can use guider rollers 7 leaning against a guiding rule to get a clean boundary. When the knob 5 is tightened with clockwise rotation, orientation teeth 6-4 on the orientation part engage the adjusting teeth 2 in the top of handle, this movement generates enough engaging force to guarantee stable angle between the pad support body and the handle during operation, this suits for small area painting. When knob is loosed with counter clockwise rotation, the handle 1 can swing within 0°-90° pivotal movement relating to pad support body 3, this suits for large area painting freely.

What is claimed is:

1. A paint pad with adjustable handle comprising:

a handle;

a pad unit including a pad supporting body, a pad holder plate attached to a bottom of said pad supporting body; wherein said pad supporting body having a handle groove located on a top surface of said pad supporting body;

an orientation part located under said handle groove, a plurality of orientation teeth are on a surface of the orientation part;

said handle having an end with a plurality of adjusting teeth, which is inserted into said handle groove and connected with the handle groove by an axis;

a knob for adjusting the engaging relationship between said orientation teeth and adjusting teeth located on the top surface of said pad supporting body;

a connecting channel located at a front end of said handle groove, a screw hole located at a front end of said orientation part, said knob includes a knob head, a screw thread and a stopping shoulder between the knob head and screw thread, a section between the knob head and the stopping shoulder is inserted moveably into said connecting channel, said screw thread is connected with said screw hole in screw connection.

2. The paint pad of claim 1, wherein two guide rollers are connected at a front end of said pad supporting body.

3. The paint pad of claim 2, wherein said pad support body has cavity at front top thereof, two roller shafts stand vertically related to said pad holder plate inside said cavity, said guider rollers are on said roller shafts moveably.

4. The paint pad of claim 2, wherein flanges located on opposite sides of the pad holder plate connect corresponding side edges of said pad support body.

5. The paint pad of claim 4, wherein said flanges of the pad holder plate and said edges of the pad support body both possess lock grooves having same shape, which are overlapped when assembly, a flange lock with an outward-hem is inserted into said lock grooves for locking said pad support body with said pad holder plate together.

6. The paint pad of claims 2, wherein said orientation part has an open slot in rear end thereof, said orientation teeth are located between the screw hole and the open slot; two open blind slots having down direction are located on both sides of said open slop to connect with stationary protrudes on both side of the rear section of said handle groove.

7. The paint pad of claim 1, wherein a paint pad is attached under said pad holder plate, nylon hairs are planted on outside of said paint pad, or a sponge with nylon hair is adhered said paint pad.

8. The paint pad of claims 1, wherein the connecting end of said handle is a cylindrical shape, two bottoms of said cylinder moveably touch two side surfaces of said handle groove respectively, a transverse axis is located a center of said cylinder, the side surfaces of said handle groove have a couple of opposite slots, two ends of said transverse axis set in said opposite slots.

9. The paint pad of claims 1, wherein said orientation part has an open slot in rear end thereof, said orientation teeth are located between the screw hole and the open slot; two open blind slots having down direction are located on both sides of said open slop to connect with stationary protrudes on both side of the rear section of said handle groove.

10. The paint pad of claims 1, wherein said handle is wrapped with soft material to increase comfortable holding for long periods, and has a screw bore in an end of the handle.

* * * * *